US008138034B2

(12) United States Patent
Han et al.

(10) Patent No.: US 8,138,034 B2
(45) Date of Patent: Mar. 20, 2012

(54) FLEXIBLE ELECTRET TRANSDUCER ASSEMBLY, SPEAKER, AND METHOD FOR FABRICATING FLEXIBLE ELECTRET TRANSDUCER ASSEMBLY

(75) Inventors: Wei-Kuo Han, Hsinchu (TW); Ming-Daw Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 855 days.

(21) Appl. No.: 12/185,827

(22) Filed: Aug. 5, 2008

(65) Prior Publication Data

US 2009/0304212 A1 Dec. 10, 2009

(30) Foreign Application Priority Data

Jun. 5, 2008 (TW) ..... 97120995 A

(51) Int. Cl.
*H04R 19/01* (2006.01)

(52) U.S. Cl. ..... 438/191

(58) Field of Classification Search ..... 381/191
See application file for complete search history.

(56) References Cited

U.S. PATENT DOCUMENTS

| | | | | |
|---|---|---|---|---|
| 4,249,043 | A | 2/1981 | Morgan et al. | |
| 2006/0177083 | A1 * | 8/2006 | Sjursen et al. | 381/322 |
| 2007/0121967 | A1 * | 5/2007 | Sjursen et al. | 381/111 |

* cited by examiner

*Primary Examiner* — Alexander Ghyka
*Assistant Examiner* — Stanetta Isaac
(74) *Attorney, Agent, or Firm* — Jianq Chyun IP Office

(57) ABSTRACT

A flexible electret transducer assembly including an electrical backplate and a membrane made of an electret material is disclosed. A plurality of spacers is formed on a surface of the electrical backplate in a longitudinal or latitudinal direction, and the spacers are used for supporting a vibrating room of the membrane. A working area of the membrane is formed between adjacent spacers, and in each of the working area, the space between the electrical backplate and the membrane is smaller than that in a conventional electrostatic speaker. The spacers between the electrical backplate and the membrane are mass produced through a stamping process. Thereby, an accurate space between the electrical backplate and the membrane can be maintained and accordingly the audio quality can be improved. In addition, a speaker including the flexible electret transducer assembly and a method for fabricating the flexible electret transducer assembly are also disclosed.

40 Claims, 14 Drawing Sheets

FLEXIBLE ELECTRET TRANSDUCER ASSEMBLY, SPEAKER, AND METHOD FOR FABRICATING FLEXIBLE ELECTRET TRANSDUCER ASSEMBLY

CROSS-REFERENCE TO RELATED APPLICATION

This application claims the priority benefit of Taiwan application serial no. 97120995, filed on Jun. 5, 2008. The entirety of the above-mentioned patent application is hereby incorporated by reference herein and made a part of this specification.

BACKGROUND OF THE INVENTION

1. Field of the Invention

The present invention generally relates to a flexible electret transducer assembly, and more particularly, to a flexible electret transducer assembly having a membrane made of an electret material. The present invention also relates to a speaker having the flexible electret transducer assembly and a method for fabricating the flexible electret transducer assembly.

2. Description of Related Art

Vision and audition are the most direct sensory responses of human beings. Thus, scientists have been dedicated to developing various renewable vision and audition related systems. Moving coil speaker is still the major product in the market among all the existing renewable speakers. However, along with people's increasing demand to high quality sensory enjoyment and the ever-decreasing sizes of 3C products (Computer, Communication, and Consumer Electronics), speakers which have low power consumption, light weights, and small sizes and are designed according to human factors engineering are to be developed and broadly applied in the near future.

The existing speakers can be categorized into direct and indirect types according to their radiation patterns or can be categorized into moving coil speaker, piezoelectric speaker, and electrostatic speaker according to the driving patterns thereof. The moving coil speaker is currently the most commonly used and most mature product. However, a moving coil speaker cannot be compressed due to the physical structure thereof. Accordingly, moving coil speaker is not suitable for 3C products and home entertainment systems which have their sizes reduced constantly.

A piezoelectric speaker pushes a membrane to produce sounds based on the piezoelectric effect of an electrical material (i.e., the material is deformed when an electric field is supplied thereon). A piezoelectric speaker has a compressed and small structure. Electrostatic speaker is a hi-end earphone or speaker in the current market. According to the operation principle of a conventional electrostatic speaker, a conductive membrane is disposed between two open-hole electrical backplates to form a capacitor. An electric field is produced by supplying a DC bias to the membrane and an AC voltage to the two electrical backplates. The conductive membrane is driven by the electrostatic force generated by the electric field to vibrate and accordingly produce audio. The conventional electrostatic speaker needs a bias of up to hundreds or even thousands voltages, and accordingly a high-cost and bulky amplifier has to be used and which makes the conventional electrostatic speaker very difficult to be promoted.

An electret transducer assembly is disclosed in U.S. Pat. No. 4,249,043. This electret transducer assembly includes a plastic body and a screwed-in central recess. In addition, an electrical backplate having a plurality of protrusions and vent holes is assembled to the body through a screw, wherein the screw threads of the bolt and the nut are connected to each other. In addition, an aluminum-coated electret membrane is extended along an exposed surface of the electrical backplate and is separated from the electrical backplate by the protrusions on the electrical backplate. In this patent, the electrical backplate and the protrusions are formed integrally. Because the material for forming the electrical backplate is highly adhesive and accordingly requires enough room to flow, the electret transducer assembly cannot be made too thin, especially when it is formed integrally with the bolts. Thus, this patent is only suitable for non-flexibly applications.

Audio is a major element in the future applications of flexible electronics. However, flexible electronics has to have the characteristics of softness, thinness, low driving voltage, and high flexibility. Thus, how to fabricate elements having the characteristics of flexible electronics has become a major subject.

The space between the electrical backplate and the membrane in a conventional electrostatic electret transducer assembly is about 0.5 mm. To achieve an electric field of sufficient intensity for driving the membrane, a voltage of hundreds or even thousands voltages is required such that the vibrated membrane can push the air and accordingly produce sounds. Even though the entire thickness of an electret transducer assembly is as thin as a few millimeters, it cannot be applied to a portable product or a product which is rolled up to further reduce the surface area. Moreover, the circuit driver for providing the high voltage usually has a large volume, which also makes it impossible to reduce the size of the electret transducer assembly.

Accordingly, a flexible and small electret transducer assembly is desired, and the fabrication of this assembly should be simple and suitable for mass production.

SUMMARY OF THE INVENTION

Accordingly, the present invention is directed to a flexible electret transducer assembly which overcomes the limitations and disadvantages in the existing techniques. The present invention is also directed to a speaker having a flexible electret transducer assembly and a method for fabricating the flexible electret transducer assembly.

The present invention provides a flexible electret transducer assembly including an electrical backplate and a membrane. The space between the electrical backplate and the membrane is much smaller than that in a conventional electrostatic speaker. Besides, an electric field can be formed by supplying a low voltage to an electrical film on the electrical backplate and a conductive film on the membrane so as to push the membrane to produce audio. Hollow protruding spacers are mass produced between the electrical backplate and the membrane through a stamping process or a rolling process such that an accurate space can be maintained between the electrical backplate and the membrane. The disposition pattern of these spacers can be adjusted according to the actual requirement so as to improve the audio quality and the flexibility of the electret transducer assembly. In addition, the design of the electret transducer assembly allows it to be mass produced.

The present invention provides a speaker having a flexible electret transducer assembly. The speaker includes a membrane and an electrical backplate. The membrane is made of an electret material, and a conductive film is disposed on the membrane. A plurality of protruding spacers, a plurality of vent holes, and an electrical film are disposed on a film layer of the electrical backplate.

The present invention further provides a method for fabricating a flexible electret transducer assembly. The method includes following steps. First, a membrane is fabricated by using an electret material, and a conductive film is formed on an surface of the membrane. A plurality of protruding spacers and a plurality of vent holes are formed on a film layer of the electrical backplate through a stamping process or a rolling process, and an electrical film is formed on the film layer of the electrical backplate. Finally, the hollow protruding spacers of the electrical backplate are attached to the membrane to form a flexible electret transducer assembly.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIGS. 1A~1C are respectively a schematic diagram, a cross-sectional diagram, and a partial cutaway diagram of a flexible electret transducer assembly according to a first embodiment of the present invention, wherein FIG. 1B is an enlarged cross-sectional diagram of the flexible electret transducer assembly along line I-I in FIG. 1A.

FIG. 2A and FIG. 2B are respectively a schematic diagram and a cross-sectional diagram of a flexible electret transducer assembly according to a second embodiment of the present invention, wherein FIG. 2B is an enlarged cross-sectional diagram of the flexible electret transducer assembly along the line II-II in FIG. 2A.

DESCRIPTION OF THE EMBODIMENTS

Figure 1A:
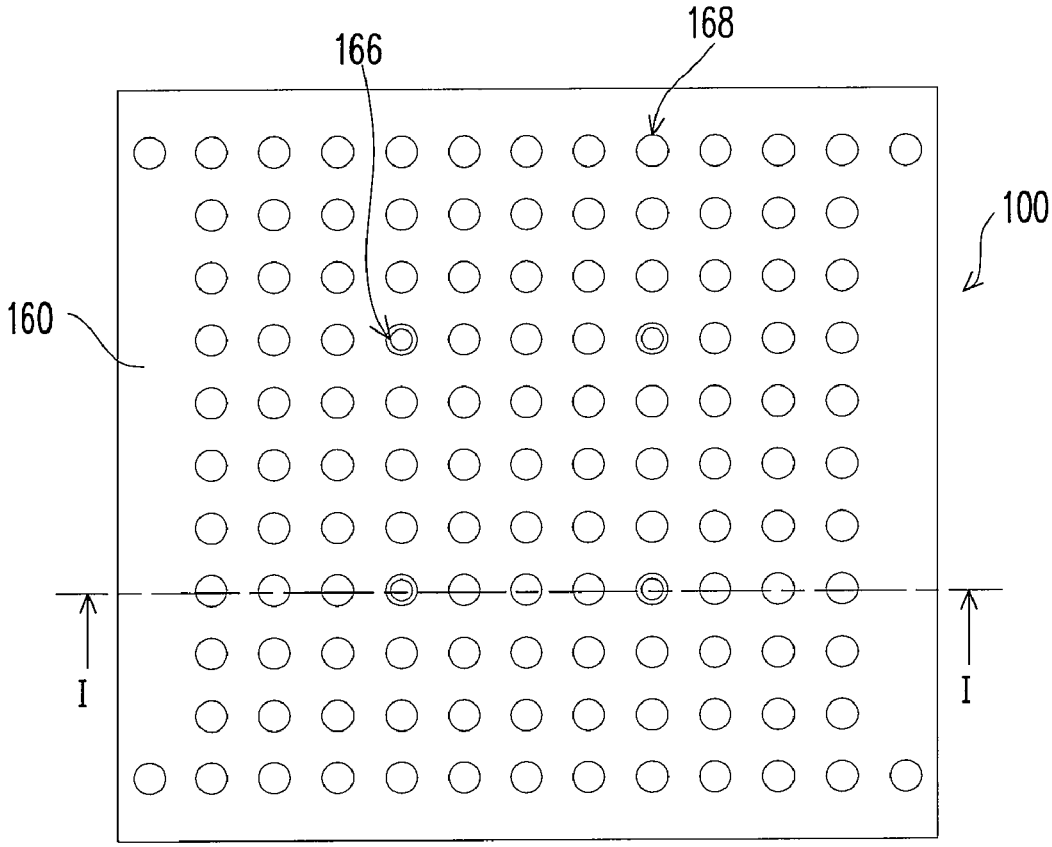

Reference will now be made in detail to the present preferred embodiments of the invention, examples of which are illustrated in the accompanying drawings. Wherever possible, the same reference numbers are used in the drawings and the description to refer to the same or like parts.

Embodiments of the present invention are illustrated in accompanying drawings. However, these embodiments are not intended to limiting the scope of the present invention. Contrarily, these embodiments are only used for describing the technique provided by the present invention more clearly so that those skilled in the art can implement the present invention according to the present disclosure. In the accompanying drawings, the sizes of different layers and areas may be enlarged out of proportion in order to make the drawings more clear. Like reference numerals refer to like elements throughout the present disclosure.

Figure 1B:
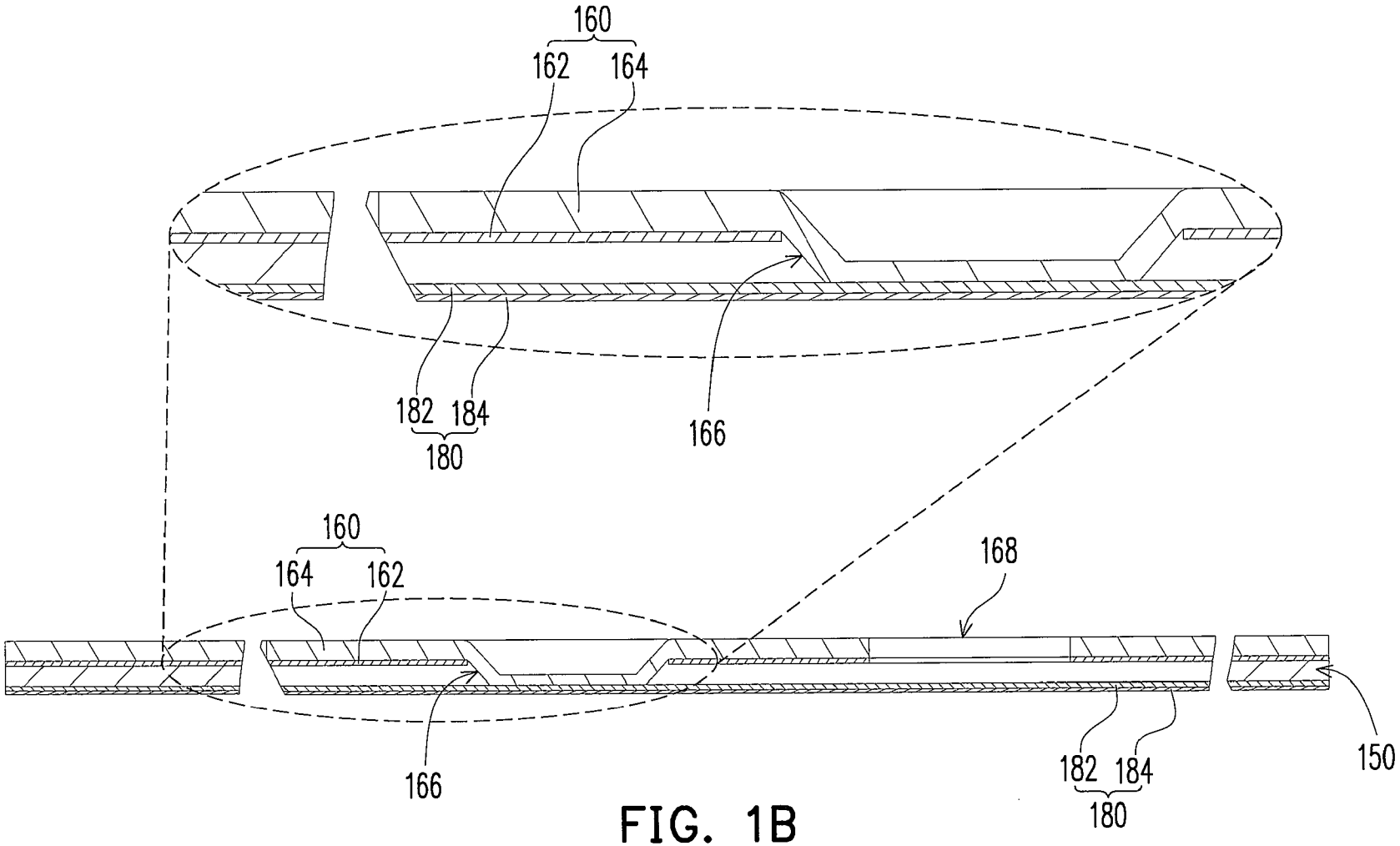
Figure 1C:
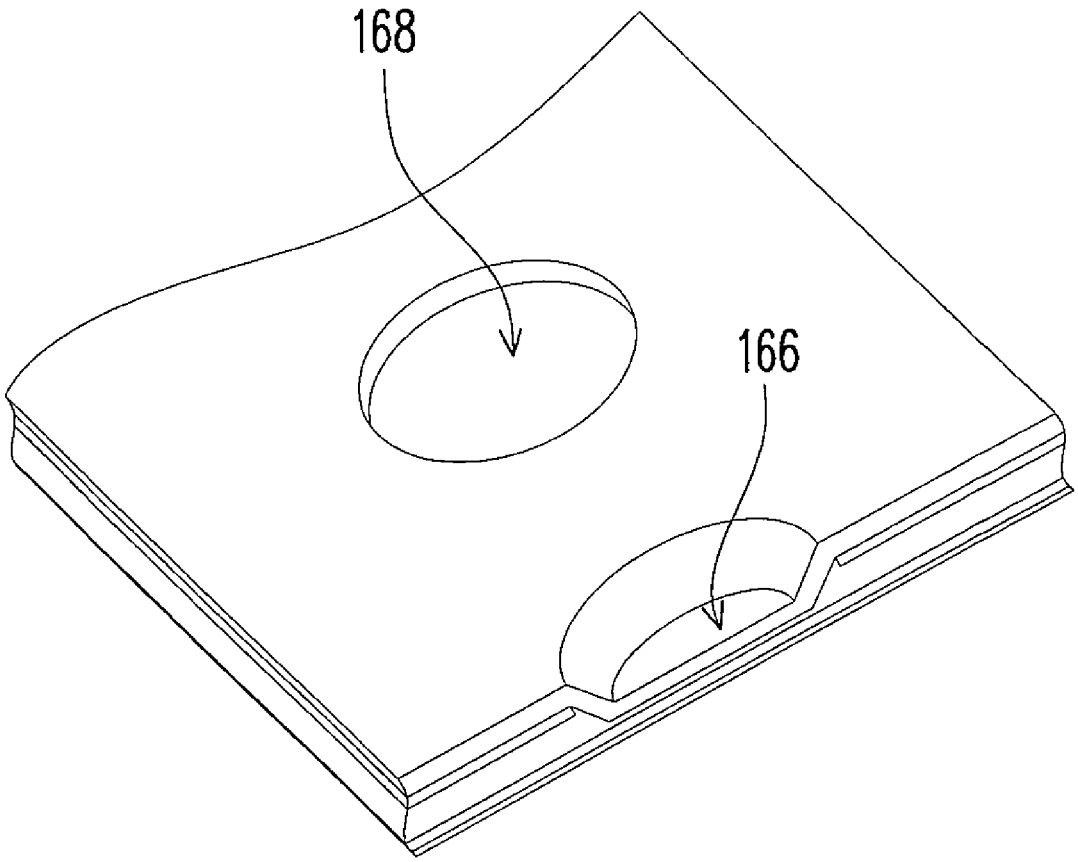

FIGS. 1A~1C are respectively a schematic diagram, a cross-sectional diagram, and a partial cutaway diagram of a flexible electret transducer assembly according to a first embodiment of the present invention, wherein FIG. 1B is an enlarged cutaway diagram of the flexible electret transducer assembly along line I-I in FIG. 1A.

Referring to FIG. 1A and FIG. 1B, in the present embodiment, the flexible electret transducer assembly 100 includes a membrane 180, an electrical backplate 160, and a frame 150. The membrane 180 is composed of an electret 182, and a conductive film 184 is formed on the electret 182. The conductive film 184 can be formed on the electret 182 through sputtering, attaching, or printing. The frame 150 is used for attaching the border of the membrane 180 to the border of the electrical backplate 160. The electrical backplate 160 is composed of a film layer 164, and an electrical film 162 made of a conductive material may be selectively disposed on the film layer 164 according to the material thereof.

A plurality of hollow protruding spacers 166 and a plurality of vent holes 168 are disposed on the electrical backplate 160. The hollow protruding spacers 166 are respectively protruded from the film layer 164 of the electrical backplate 160 to serve as spacers between the electrical backplate 160 and the membrane 180, and the cross-sectional structure thereof is in U shape. While assembling the elements, the protruding sides of the hollow protruding spacers 166 are attached to the membrane 180 to serve as spacers such that an accurate space between adjacent two spacers can be maintained between the electrical backplate 160 and the membrane 180. In an embodiment of the present invention, the protruding sides of the hollow protruding spacers 166 are glued to the electret 182 of the membrane 180. In another embodiment of the present invention, the protruding sides of the hollow protruding spacers 166 are attached to the electret 182 of the membrane 180 through the frame 150. The vent holes 168 connect the air in the space between the electrical backplate 160 and the membrane 180 with air at outside. When the membrane 180 vibrates between adjacent two hollow protruding spacers, the membrane 180 pushes the air in or out of the vent holes 168 and accordingly produces sounds.

Referring to FIG. 1B, in an embodiment of the present invention, the hollow protruding spacers 166 may be formed integrally on the film layer 164 of the electrical backplate 160 through a stamping process or a rolling process. Thus, it is not necessary to adhere spacers on the film layer 164 of the electrical backplate 160 additionally. As a result, the thickness of the hollow protruding spacers 166 which receive pressure are kept unchanged, and at the same time, the electret transducer assembly 100 won't be deformed or separated. Furthermore, an accurate space can be maintained between the electrical backplate 160 and the membrane 180. Because the space between the electrical backplate 160 and the membrane 180 is determined according to the thickness of the portions of the hollow protruding spacers 166 which exceed the electrical backplate 160, in the condition that the hollow protruding spacers 166 can be fabricated with very small thickness and accurate size, the space between the electrical backplate 160 and the membrane 180 can be reduced to about 0.1 mm. When the space between the electrical backplate 160 and the membrane 180 is reduced to about 0.1 mm and a low voltage is supplied to the electrical film 162 on the electrical backplate 160 and the conductive film 184 on the membrane 180, a sufficient electric field can be formed between the electrical backplate 160 and the membrane 180 for pushing the membrane to produce audio. Thus, in the electret transducer assembly 100 of the present embodiment, both the input voltage and the size of the electret transducer assembly 100 are effectively reduced, and accordingly, the flexibility of the electret transducer assembly 100 is improved.

Referring to FIG. 1B again, in the present embodiment, the film layer 164 and the electrical film 162 of the electrical backplate 160 are respectively a nonconductive film layer 164 and a conductive electrical film 162. When the film layer 164 is made of a nonconductive material such as plastic (PET, PC), rubber, paper, nonconductive cloth (cotton fibre or polymer fibre), the electrical film 162 is then made of a pure metal material such as aluminum, gold, silver, copper, or an alloy thereof, or a bi-metal material such as Ni/Au, or indium tin oxide (ITO), indium zinc oxide (IZO), or a combination thereof, or polymer conductive material PEDOT, etc.

As described above, in another embodiment of the present invention, if the film layer 164 is made of a conductive material, such as metal (iron, copper, aluminum or an alloy thereof) or a conductive cloth (metal fibre, metal oxide fibre, carbon fibre, or graphite fibre), the electrical film 162 is not disposed since the film layer 164 itself is conductive.

FIG. 1C is a partial cutaway diagram of the hollow protruding spacers 166 and the vent holes 168 on the film layer 164 of the electrical backplate 160, wherein the hollow protruding spacers 166 may be formed on the film layer 164 of the electrical backplate 160 through a stamping process or a rolling process.

Figure 1D:
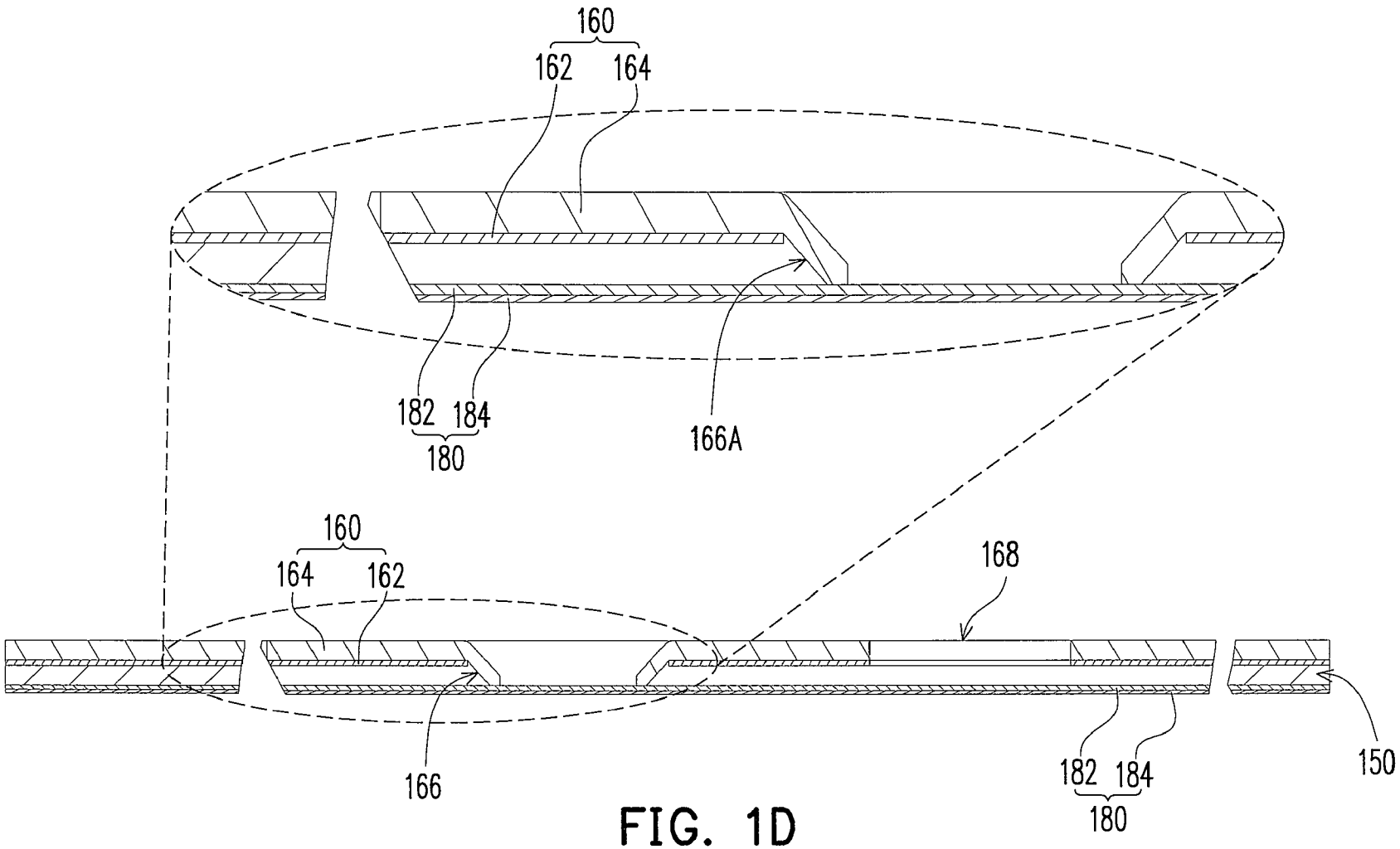
FIGS. 1D~1E are respectively a cross-sectional diagram and a partial cutaway diagram of a flexible electret transducer assembly according to different embodiments of the present invention.
Figure 1E:
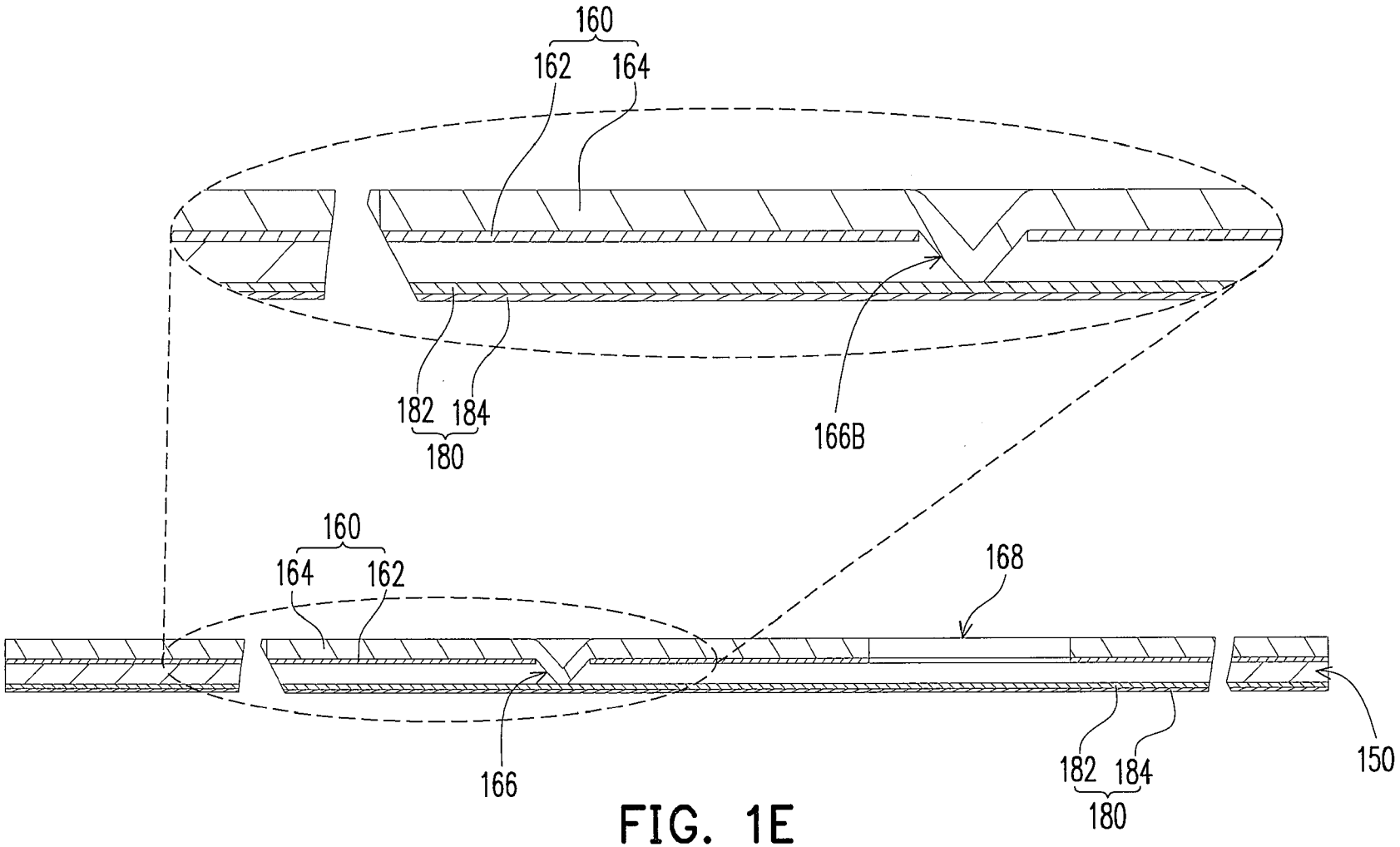
Figure 2A:
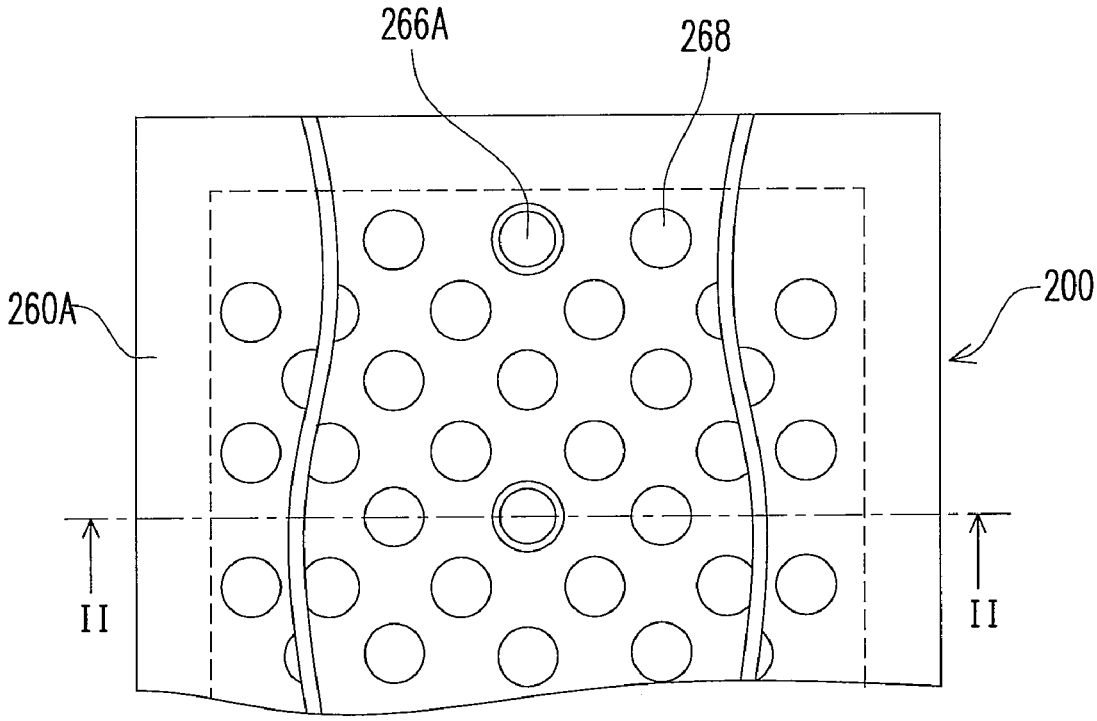
Figure 2B:
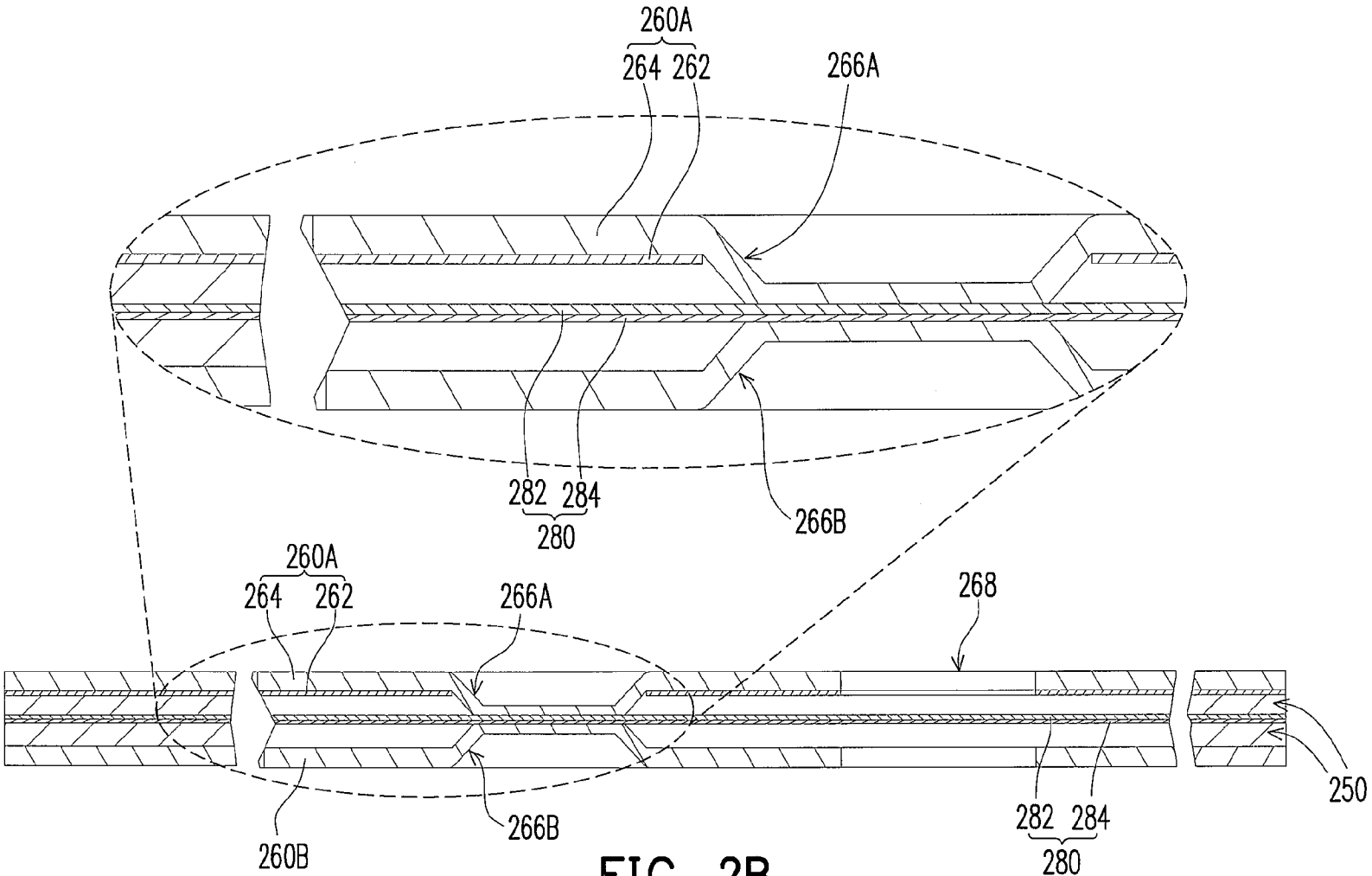

Referring to FIG. 1D, in an embodiment of the present invention, the hollow protruding spacers 166A have a through structure, namely, the protruded portions of the hollow protruding spacers 166A have a through structure, and such that only parts of the protruding surfaces of the hollow protruding spacers 166A are attached to the electret 182 of the membrane 180. Referring to FIG. 1E, in another embodiment of the present invention, the hollow protruding spacers 166B have a conical structure, namely, the protruded portions of the hollow protruding spacers 166B have a conical structure, and such that the areas of the hollow protruding spacers 166B attached to the electret 182 of the membrane 180 are very small. As a result, the flexibility of the electret transducer assembly is increased. FIG. 2A and FIG. 2B are respectively a schematic diagram and a cross-sectional diagram of a flexible electret transducer assembly according to a second embodiment of the present invention.

Referring to FIG. 2A and FIG. 2B, in the present embodiment, a bi-layer electrical backplate structure is adopted by the flexible electret transducer assembly 200 such that the vibrating room of the membrane can be controlled more effectively. In other words, the membrane is fixed by the hollow protruding spacers on two electrical backplates so that an accurate space can be maintained between the membrane and the two electrical backplates and between adjacent hollow protruding spacers.

The structure and elements in the flexible electret transducer assembly 200 which are the same as those in the flexible electret transducer assembly 100 described in the first embodiment will not be described herein. The flexible electret transducer assembly 200 includes a membrane 280, two electrical backplates 260A and 260B, and a frame 250. The membrane 280 is composed of an electret 282, and a conductive film 284 is formed on the electret 282. The conductive film 284 may be formed on the electret 282 of the membrane 280 through sputtering, attaching, or printing. The frame 250 is used for attaching the border of the membrane 280 to the border of the electrical backplates 260A and 260B. The electrical backplates 260A and 260B respectively have a plurality of hollow protruding spacers 266A and 266B and a plurality of vent holes 268. The hollow protruding spacers 266A and 266B are respectively protruded from the electrical backplates 260A and 260B to serve as spacers between the electrical backplates 260A and 260B and the membrane 280 and have a U-shape cross-sectional structure. While assembling these elements, the protruding sides of the hollow protruding spacers 266A and 266B are attached to the membrane 280 to serve as spacers, so that an accurate space between adjacent two spacers can be maintained between the electrical backplates 260A and 260B and the membrane 280. The vent holes 268 connect the air in the space between the electrical backplates 260A and 260B and the membrane 280 with the air outside. When the membrane 280 vibrates, it pushes the air in and out through the vent holes 268 to produce sounds. The audio effect produced by this bi-layer structure is not distorted.

In the two embodiments described above, the hollow protruding spacers and vent holes on the film layer of the electrical backplate are disposed correspondingly, wherein some areas can be adjusted according to the actual requirement. In another embodiment of the present invention, the positions of the vent holes and the hollow protruding spacers on the film layer of the electrical backplate may be considered separately. Namely, the hollow protruding spacers may be disposed between the vent holes or at spaces additionally designed.

For example, the hollow protruding spacers having a U-shape cross-section in foregoing embodiment can be disposed between the original positions of the vent holes as long as a working area of the membrane can be formed between adjacent spacers and the vibrating room of the membrane can be supported. In another embodiment of the present invention, a plurality of longitudinal or latitudinal spacers may be disposed on the film layer of the electrical backplate for supporting the vibrating room of the membrane. A working area of the membrane is formed between adjacent spacers, and in each of the working area, the space between the electrical backplate and the membrane is smaller than that in a conventional electrostatic speaker. The spacers between the electrical backplate and the membrane are mass produced through a stamping process so that an accurate space can be maintained between the electrical backplate and the membrane and accordingly the audio quality can be improved.

In an embodiment of the present invention, the hollow protruding spacers 266A may have a through structure, namely, the protruding sides of the hollow protruding spacers 266A have a through structure, and such that only parts of the protruding sides of the hollow protruding spacers 266A are attached to the electret 282 of the membrane 280. In another embodiment of the present invention, the hollow protruding spacers 266B have a conical structure, namely, the protruding portions of the hollow protruding spacers 266B have a conical structure, and such that only a small area of the protruded portions of the hollow protruding spacers 266A is attached to the electret 282 of the membrane 280. As a result, the flexibility of the electret transducer assembly is improved.

Figure 3:
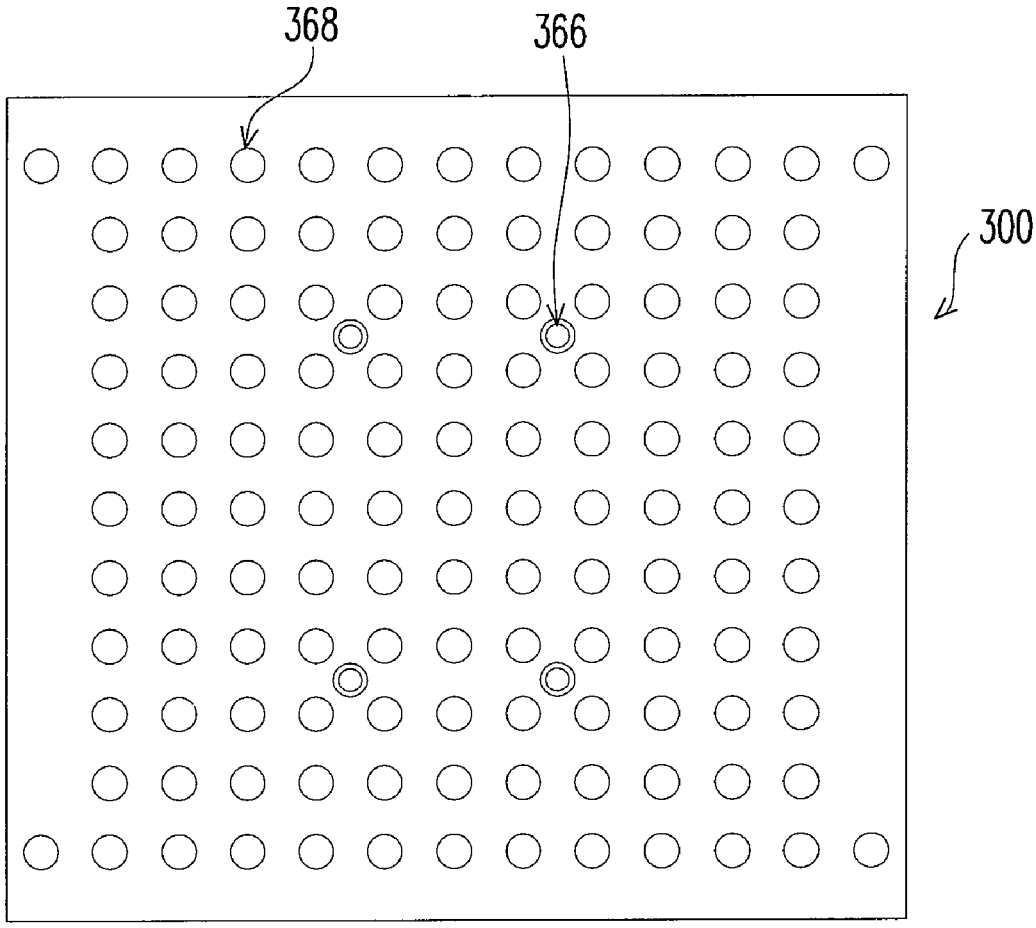
FIG. 3 is a schematic diagram of a flexible electret transducer assembly according to a third embodiment of the present invention.

FIG. 3 is a schematic diagram of a flexible electret transducer assembly according to a third embodiment of the present invention. The difference between the flexible electret transducer assembly 300 in the present embodiment and the flexible electret transducer assembly 100 in the first embodiment is that the hollow protruding spacers 366 in the present embodiment are disposed between the vent holes 368.

In an embodiment of the present invention, the hollow protruding spacers in the flexible electret transducer assembly 300 may also adopt a through structure besides the U-shape structure illustrated in FIG. 1B. Namely, the protruding sides of the hollow protruding spacers have a through structure, and such that only parts of the protruding surfaces of the hollow protruding spacers are attached to the electret of the membrane. In another embodiment of the present invention, the hollow protruding spacers may also have a conical structure, namely, the protruding sides of the hollow protruding spacers have a conical structure, and such that only a small area of the protruding sides is attached to the electret of the membrane. As a result, the flexibility of the electret transducer assembly is improved.

Figure 4A:
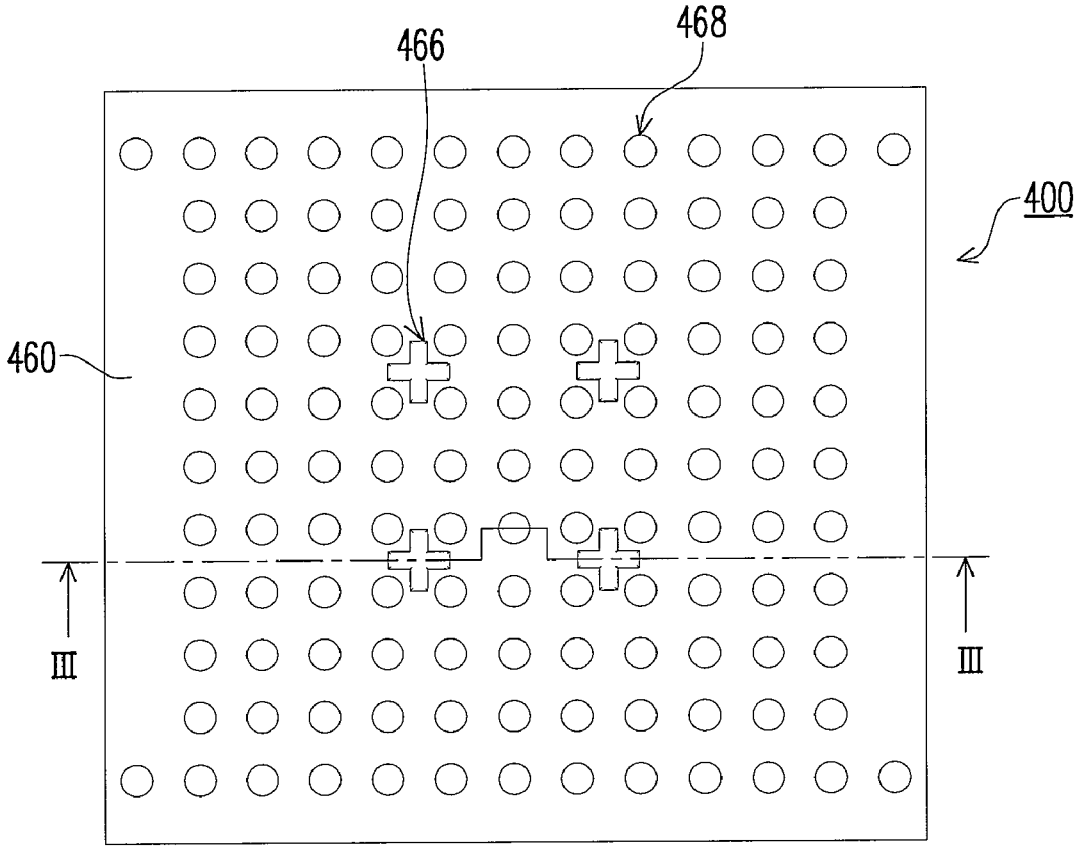
FIG. 4A is a schematic diagram of a flexible electret transducer assembly according to a fourth embodiment of the present invention.
Figure 4B:
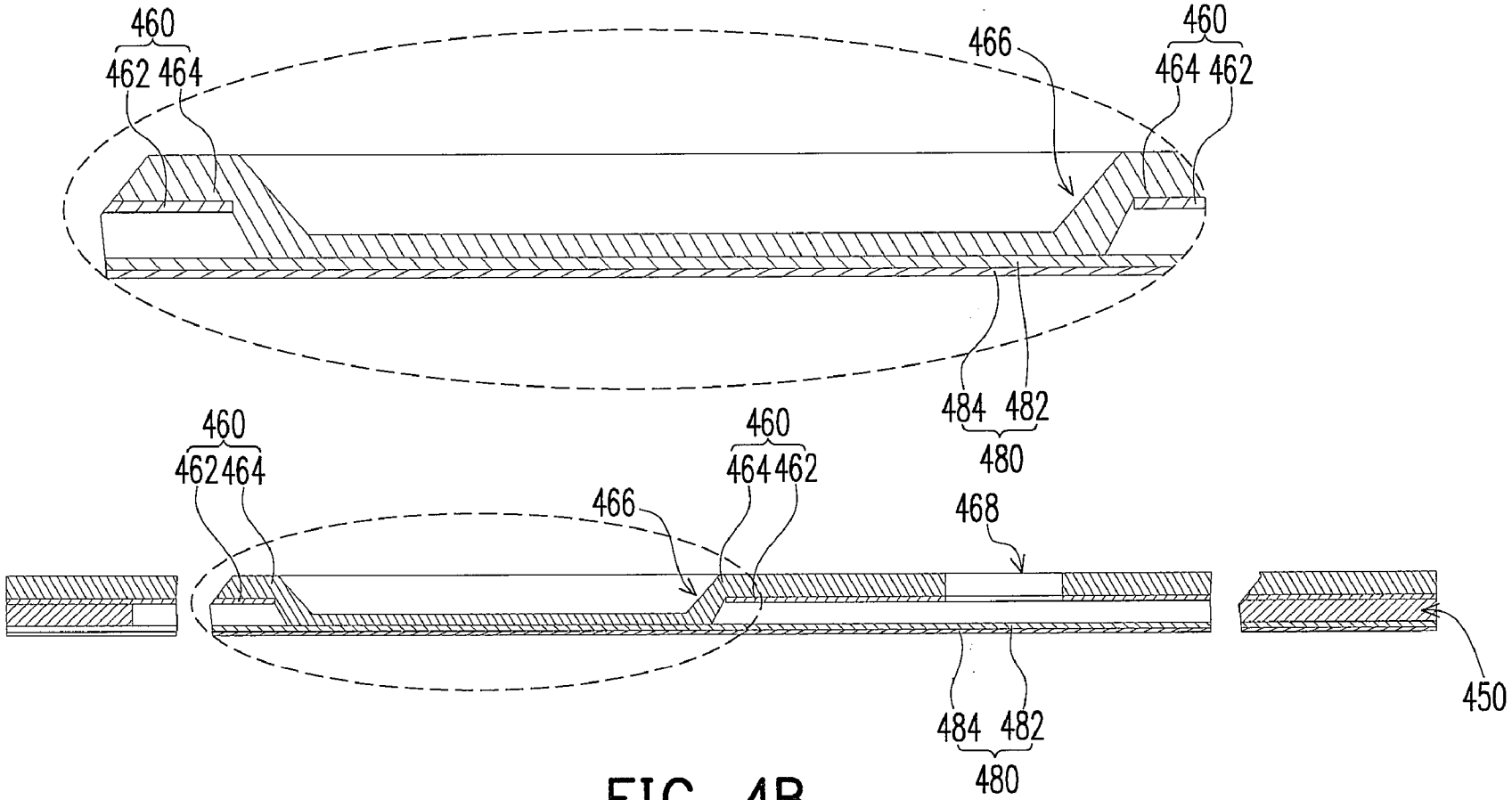
FIG. 4B is an enlarged cross-sectional diagram of the flexible electret transducer assembly in FIG. 4A along line III-III.

FIGS. 4A~4B are respectively schematic diagrams of a flexible electret transducer assembly according to a fourth embodiment of the present invention. Referring to FIG. 4A, the difference between the flexible electret transducer assembly 400 in the present embodiment and the flexible electret transducer assembly 100 in the first embodiment is that the hollow protruding spacers 466 in the present embodiment have a cross structure. The hollow protruding spacers 466 may be formed integrally on a film layer of the electrical backplate 460 through a stamping process or a rolling process, and accordingly spacers need not to be adhered additionally to the film layer of the electrical backplate 460. Thus, the thickness of the hollow protruding spacers 466 which receive pressure is kept unchanged and at the same time, the electret transducer assembly 400 won't be deformed or separated. Furthermore, an accurate space between the electrical backplate 460 and the membrane 480 can be maintained.

As shown in FIG. 4B, the flexible electret transducer assembly 400 includes a membrane 480, an electrical backplate 460, and a frame 450. The membrane 480 is composed of an electret 482, and a conductive film 484 is formed on the electret 482. The conductive film 484 may be formed on the membrane 480 through sputtering, attaching, or printing. The frame 450 is used for attaching the border of the membrane 480 to the border of the electrical backplate 460. In an embodiment of the present invention, the protruding sides of the hollow protruding spacers 466 are adhered to the electret 482 of the membrane 480 by using nonconductive adhesive. In another embodiment of the present invention, the protruding sides of the hollow protruding spacers 466 are attached to the electret 482 of the membrane 480 through the frame 450. The electrical backplate 460 is composed of a film layer 464, and a conductive electrical film 462 may be selectively formed on the film layer 464 according to the material thereof. A plurality of hollow protruding spacers 466 and a plurality of vent holes 468 are disposed on the film layer 464 of the electrical backplate 460.

In an embodiment of the present invention, the film layer 464 and the electrical film 462 of the electrical backplate 460 are respectively a nonconductive film layer 464 and a conductive electrical film 462.

When the film layer 464 is made of a nonconductive material such as plastic (PET, PC), rubber, paper, nonconductive cloth (cotton fibre or polymer fibre), the electrical film 462 may be made of a pure metal material such as aluminum, gold, silver, copper, or an alloy thereof, a bi-metal material such as Ni/Au, ITO, IZO, or a combination thereof, or polymer conductive material PEDOT, etc.

As described above, in another embodiment of the present invention, if the film layer 464 is made of a conductive material, such as metal (for example, iron, cooper, aluminum, or an alloy thereof), or conductive cloth (metal fibre, metal oxide fibre, carbon fibre, or graphite fibre), the electrical film 462 is then not disposed since the film layer 464 itself is conductive.

In an embodiment of the present invention, the hollow protruding spacers 466 the flexible electret transducer assembly 400 may also adopt a through structure, namely, the protruding portions of the hollow protruding spacers may have a through structure, and such that only parts of the protruding portions of the hollow protruding spacers 466 are attached to the electret 482 of the membrane 480. In another embodiment of the present invention, the bottom of the hollow protruding spacers 466 may have a pointed cross-sectional design such that the area of the hollow protruding spacers 466 attached to the electret of the membrane is reduced and accordingly the sensitivity of the membrane is improved.

Figure 5:
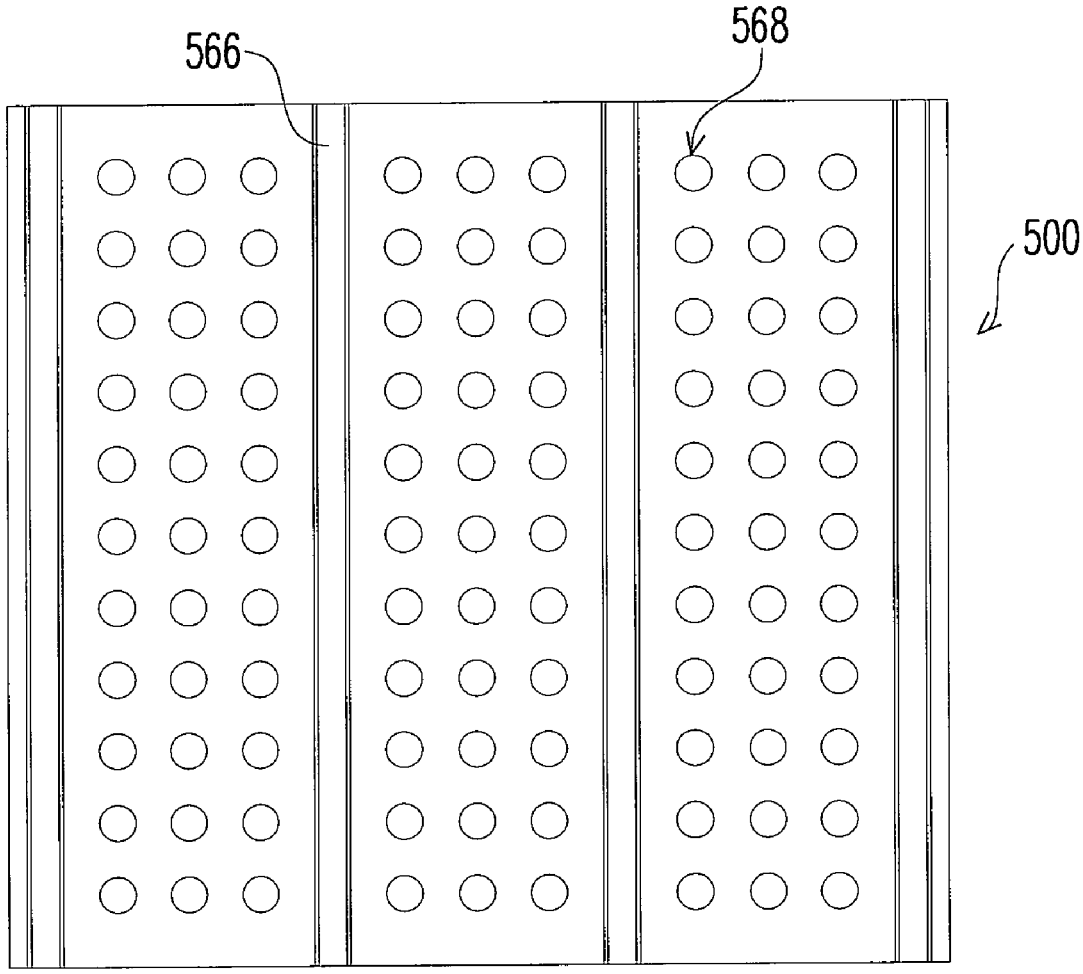
FIG. 5 is a schematic diagram of a flexible electret transducer assembly according to a fifth embodiment of the present invention.

FIG. 5 is a schematic diagram of a flexible electret transducer assembly according to a fifth embodiment of the present invention. The difference between the flexible electret transducer assembly 500 in the present embodiment and the flexible electret transducer assembly 100 in the first embodiment is that the hollow protruding spacers 566 in the present embodiment are in strip shape. The advantage of the strip-shaped hollow protruding spacers 566 is that the thickness of the flexible electret transducer assembly 500 can be greatly reduced, and accordingly the flexible electret transducer assembly 500 can be bended in a smaller radius (in a direction perpendicular to the strip direction). Thus, the flexible electret transducer assembly 500 is suitable for scroll style speakers or flexible speakers. Because the space between the electrical backplate and the membrane of the flexible electret transducer assembly 500 is determined according to the thickness of the protruded portions of the strip-shaped hollow protruding spacers exceeding the electrical backplate, in the condition that the hollow protruding spacers can be fabricated with reduced thickness and accurate size, the space between the electrical backplate and the membrane can be reduced to about 0.1 mm.

Figure 6A:
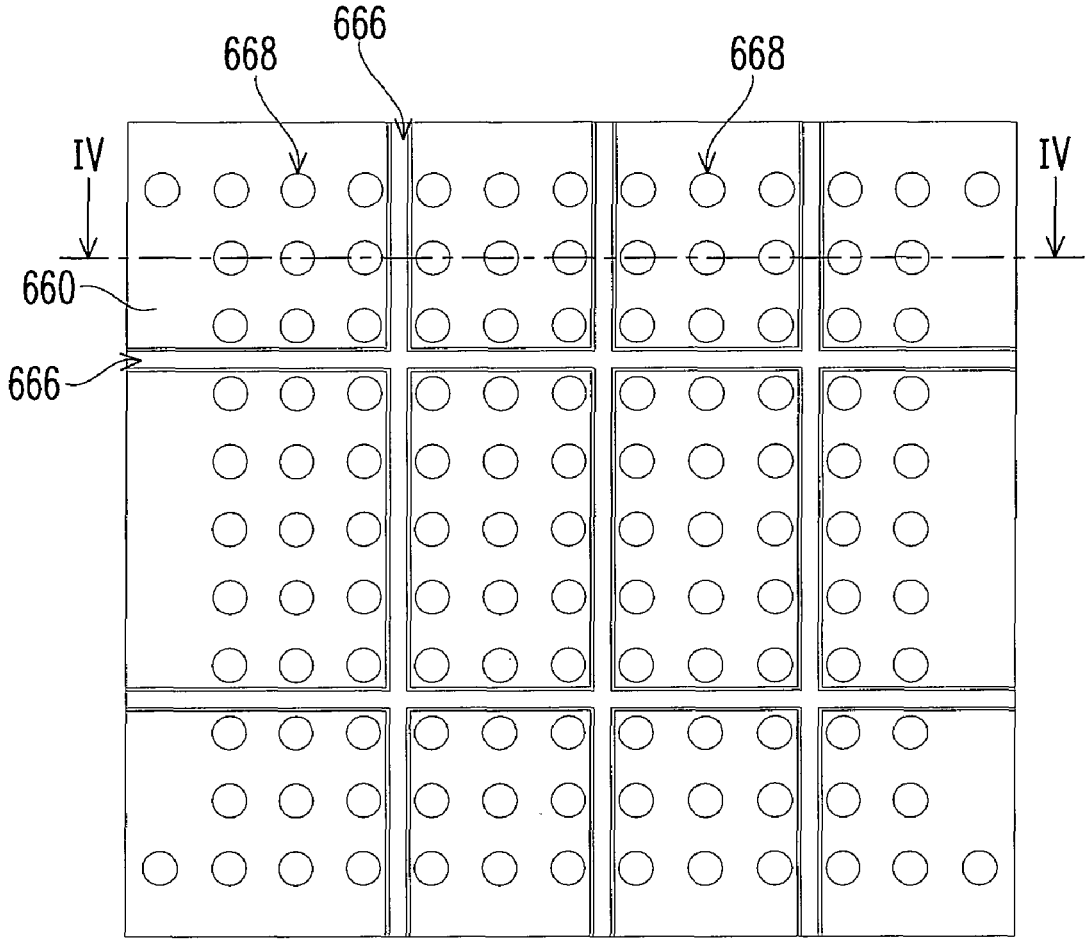
FIG. 6A is a schematic diagram of a flexible electret transducer assembly according to a sixth embodiment of the present invention.
Figure 6B:
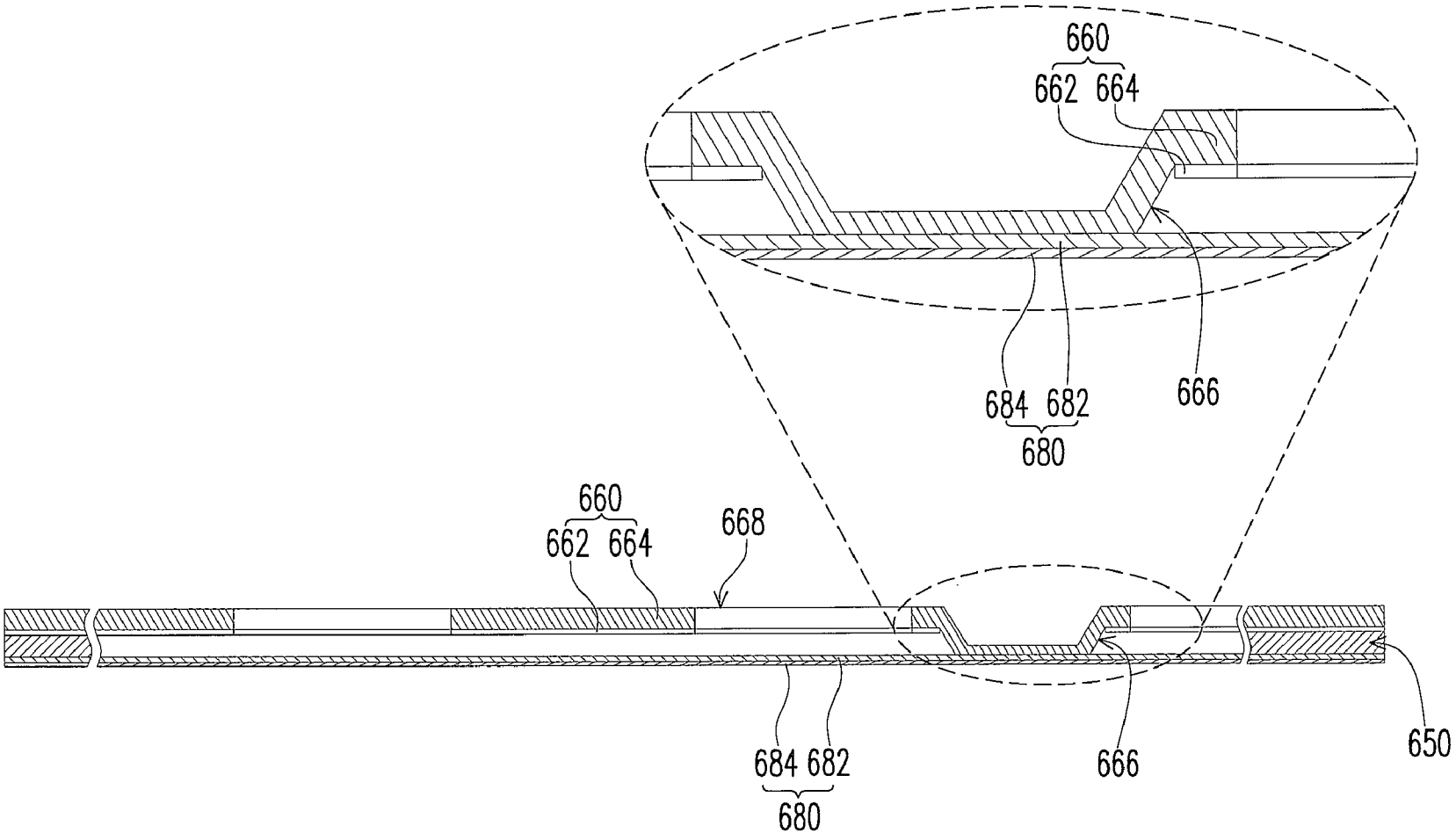
FIG. 6B is an enlarged cross-sectional diagram of the flexible electret transducer assembly in FIG. 6A along line IV-IV.

FIGS. 6A~6B are respectively schematic diagrams of a flexible electret transducer assembly according to a sixth embodiment of the present invention. Referring to FIG. 6A, the difference between the flexible electret transducer assembly 600 in the present embodiment and the flexible electret transducer assembly 100 in the first embodiment is that the hollow protruding spacers 666 in the present embodiment are in "#" shape. The hollow protruding spacers 666 may be formed integrally on a film layer of the electrical backplate 660 through a stamping process or a rolling process, and accordingly, spacers need not to be adhered additionally on the film layer of the electrical backplate 660. Thus, the thickness of the hollow protruding spacers 666 which receive pressure is kept unchanged, and at the same time, the electret transducer assembly 600 won't be deformed or separated. Accordingly, an accurate space between the electrical backplate 660 and the membrane 670 can be maintained.

As shown in FIG. 6B, the flexible electret transducer assembly 600 includes a membrane 680, an electrical backplate 660, and a frame 650. The membrane 680 is composed of an electret 682, and a conductive film 684 is formed on the electret 682. The conductive film 684 may be formed on the electret 682 of the membrane 680 through sputtering, attaching, or printing. The frame 650 is used for attaching the border of the membrane 680 to the border of the electrical backplate 660. In an embodiment of the present invention, the protruding sides of the hollow protruding spacers 666 are adhered to the electret 682 of the membrane 680 by using nonconductive adhesive. In another embodiment of the present invention, the protruding sides of the hollow protruding spacers 666 are attached to the electret 682 of the membrane 680 through the frame 650. The electrical backplate 660 is composed of a film layer 664, and a conductive electrical film 662 may be selectively disposed on the film layer 664 according to the material thereof. A plurality of hollow protruding spacers 666 and a plurality of vent holes 668 are disposed on the film layer 664 of the electrical backplate 660. Because the space between the electrical backplate 660 and the membrane 680 is determined by the thickness of the protruded portions of the hollow protruding spacers 666 exceeding the electrical backplate 660, in the condition that the hollow protruding spacers 666 can be fabricated with reduced thickness and accurate size, the space between the electrical backplate 660 and the membrane 680 can be reduced to about 0.1 mm.

In an embodiment of the present invention, the film layer 664 and the electrical film 662 of the electrical backplate 660 are respectively a nonconductive film layer 664 and a conductive electrical film 662.

When the film layer 664 is made of a nonconductive material such as plastic (PET, PC), rubber, paper, nonconductive cloth (cotton fibre or polymer fibre), the electrical film 662 is then made of a pure metal material such as aluminum, gold, silver, copper, or an alloy thereof, a bi-metal material such as Ni/Au, ITO, IZO or a combination thereof, or a polymer conductive material PEDOT, etc.

As described above, in another embodiment of the present invention, if the film layer 664 is made of a conductive material, such as metal (for example, iron, cooper, aluminum or an alloy thereof), or conductive cloth (metal fibre, metal oxide fibre, carbon fibre, or graphite fibre), the electrical film 662 is not disposed since the film layer 664 itself is conductive.

Even though different layouts and patterns of the hollow protruding spacers have been described in foregoing embodiments, the present invention is not limited to these layouts and patterns; instead, the hollow protruding spacers may also have through structure, conical structure, column structure, or any other structure which is well understood by those skilled in the art. Besides, the hollow protruding spacers may be arranged straight in a latitudinal direction, alternatively in a longitudinal direction, or arranged non-alternatively in a longitudinal direction according to the actual requirement. The shapes of the hollow protruding spacers can be a round shape, a bar-like shape, a cross shape, a shape of pound sign, or a combination of the round shape, the bar shape, the cross shape or the shape of pound sign "#", as desired.

Figure 7:
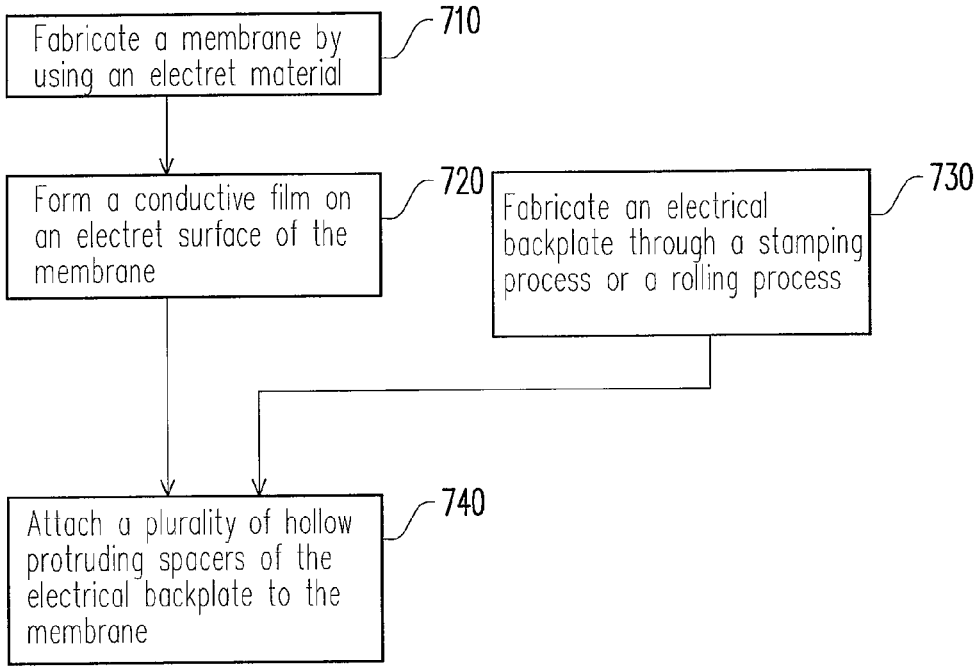
FIG. 7 is a block diagram illustrating a method for fabricating a flexible electret transducer assembly according to an embodiment of the present invention.

FIG. 7 is a block diagram of a method for fabricating a flexible electret transducer assembly according to an embodiment of the present invention. Referring to FIG. 7, the method for fabricating the flexible electret transducer assembly includes following steps. First, in step 710, a membrane is fabricated by using an electret material. Then, in step 720, a conductive film is formed on an surface of the membrane. Meanwhile, in step 730, a film layer is formed on an electrical backplate through a stamping process or a rolling process so as to allow the film layer of the electrical backplate to have a plurality of hollow protruding spacers and a plurality of vent holes, and an electrical film is formed on the film layer of the electrical backplate. After that, in step 740, the hollow protruding spacers of the electrical backplate are attached to the membrane so as to form the flexible electret transducer assembly.

Step 730 further includes a drilling step for drilling the vent holes on the film layer of the electrical backplate. The drilling step can be executed before or after the stamping process or rolling process. However, the hollow protruding spacers and the vent holes may also be formed all together on the film layer of the electrical backplate through a single stamping process by using a specific stamping die and related techniques in order to skip the separate drilling step. Because a stamping process or a rolling process is adopted in the present procedure, a thin and flexible electret transducer assembly can be fabricated and the procedure is suitable for low cost roll to roll mass production.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A flexible electret transducer assembly, comprising:

a membrane, made of an electret material, having a conductive film disposed on an surface of the membrane; and an electrical backplate, having a plurality of hollow protruding spacers and a plurality of vent holes disposed on a film layer of the electrical backplate, and having an electrical film disposed on the film layer of the electrical backplate, wherein the hollow protruding spacers of the electrical backplate are attached to the membrane.

2. The flexible electret transducer assembly according to claim 1, wherein the hollow protruding spacers are formed on the film layer of the electrical backplate through a stamping process or a rolling process.

3. The flexible electret transducer assembly according to claim 1, wherein the hollow protruding spacers are respectively protruded from the film layer of the electrical backplate and form a U-shape cross-sectional structure.

4. The flexible electret transducer assembly according to claim 1, wherein the hollow protruding spacers are respectively protruded from the film layer of the electrical backplate and form a conical-shaped cross-sectional structure.

5. The flexible electret transducer assembly according to claim 1, wherein the hollow protruding spacers are respectively protruded from the film layer of the electrical backplate, and the protruded portions of the hollow protruding spacers attached to the membrane have through holes.

6. The flexible electret transducer assembly according to claim 1, wherein the space between the electrical backplate and the membrane is determined according to the thickness of the protruded portions of the hollow protruding spacers exceeding the electrical backplate.

7. The flexible electret transducer assembly according to claim 1, wherein the film layer of the electrical backplate is made of a nonconductive material.

8. The flexible electret transducer assembly according to claim 7, wherein the film layer of the electrical backplate is made of plastic (PET or PC), rubber, paper, or nonconductive cloth.

9. The flexible electret transducer assembly according to claim 8, wherein the nonconductive cloth comprises cotton fibre or polymer fibre.

10. The flexible electret transducer assembly according to claim 1, wherein the film layer of the electrical backplate is made of a conductive material.

11. The flexible electret transducer assembly according to claim 10, wherein the electrical film of the electrical backplate is made of aluminum, gold, silver, copper, or an alloy of aluminum, gold, silver, and copper.

12. The flexible electret transducer assembly according to claim 10, wherein the electrical film of the electrical backplate is made of a bi-metal material.

13. The flexible electret transducer assembly according to claim 12, wherein the bi-metal material of the electrical film is nickel gold alloy (Ni/Au).

14. The flexible electret transducer assembly according to claim 1, wherein the electrical film of the electrical backplate is made of indium tin oxide (ITO), indium zinc oxide (IZO), a combination of ITO and IZO, or polymer conductive material PEDOT.

15. The flexible electret transducer assembly according to claim 1, wherein the hollow protruding spacers are disposed between the vent holes, or the hollow protruding spacers replace the corresponding vent holes.

16. The flexible electret transducer assembly according to claim 15, wherein the shape of the hollow protruding spacer is a round shape, a bar shape, a cross shape, a shape of pound sign, or a combination of the round shape, the bar shape, the cross shape or the shape of pound sign.

17. The flexible electret transducer assembly according to claim 15, wherein the hollow protruding spacers are arranged straight in a latitudinal direction, alternatively in a longitudinal direction, or arranged non-alternatively in a longitudinal direction.

18. The flexible electret transducer assembly according to claim 1, wherein the hollow protruding spacers at the edges are served as a frame structure.

19. The flexible electret transducer assembly according to claim 1 further comprising another electrical backplate, wherein the bottom surfaces of the hollow protruding spacers on the opposite electrical backplates are attached to each other, and the membrane is located between the bottom surfaces of the opposite hollow protruding spacers, so as to form a bi-layer electrical backplate.

20. A speaker, comprising the flexible electret transducer assembly in claim 1.

21. A flexible electret transducer assembly, comprising:

a membrane, made of an electret material, having a conductive film disposed on an surface of the membrane; and an electrical backplate, having a plurality of hollow protruding spacers and a plurality of vent holes disposed on a film layer of the electrical backplate, wherein the film layer of the electrical backplate is conductive, and the hollow protruding spacers of the electrical backplate are attached to the membrane.

22. The flexible electret transducer assembly according to claim 21, wherein the hollow protruding spacers are formed on the film layer of the electrical backplate through a stamping process or rolling process.

23. The flexible electret transducer assembly according to claim 21, wherein the hollow protruding spacers are respectively protruded from the film layer of the electrical backplate and form a U-shape cross-sectional structure.

24. The flexible electret transducer assembly according to claim 21, wherein the hollow protruding spacers are respectively protruded from the film layer of the electrical backplate and form a conical-shape cross-sectional structure.

25. The flexible electret transducer assembly according to claim 21, wherein the hollow protruding spacers are respectively protruded from the film layer of the electrical backplate, and the protruded portions of the hollow protruding spacers attached to the membrane have through holes.

26. The flexible electret transducer assembly according to claim 21, wherein the space between the electrical backplate and the membrane is determined according to the thickness of the protruded portions of the hollow protruding spacers exceeding the electrical backplate.

27. The flexible electret transducer assembly according to claim 21, wherein the film layer of the electrical backplate is made of a nonconductive material.

28. The flexible electret transducer assembly according to claim 27, wherein the film layer is made of iron, copper, aluminum, or an alloy of iron, copper, and aluminum.

29. The flexible electret transducer assembly according to claim 27, wherein the film layer of the electrical backplate is made of metal fibre conductive cloth, metal oxide fibre conductive cloth, carbon fibre conductive cloth, or graphite fiber conductive cloth.

30. The flexible electret transducer assembly according to claim 21, wherein the hollow protruding spacers are disposed between the vent holes, or the hollow protruding spacers replace the corresponding vent holes.

31. The flexible electret transducer assembly according to claim 30, wherein the shape of the hollow protruding spacer is a round shape, a bar shape, a cross shape, a shape of pound sign, or a combination of the round shape, the bar shape, the cross shape or the shape of pound sign.

32. The flexible electret transducer assembly according to claim 21, wherein the hollow protruding spacers are arranged straight in a latitudinal direction, alternatively in a longitudinal direction, or arranged non-alternatively in a longitudinal direction.

33. The flexible electret transducer assembly according to claim 21, wherein the hollow protruding spacers at the edges are served as a frame structure.

34. The flexible electret transducer assembly according to claim 21 further comprising another electrical backplate, wherein the bottom surfaces of the hollow protruding spacers on the opposite electrical backplates are attached to each other, and the membrane is located between the bottom surfaces of the opposite hollow protruding spacers, so as to form a bi-layer electrical backplate.

35. A speaker, comprising a flexible electret transducer assembly in claim 21.

36. A method for fabricating a flexible electret transducer assembly, comprising:

fabricating a membrane by using an electret material;

forming a conductive film on an surface of the membrane;

forming a film layer of an electrical backplate through a stamping process or a rolling process so as to allow the film layer of the electrical backplate to have a plurality of hollow protruding spacers and a plurality of vent holes; and attaching the hollow protruding spacers of the electrical backplate and the membrane.

37. The method according to claim 36, wherein the step for forming the electrical backplate further comprises drilling the vent holes on the film layer of the electrical backplate.

38. The method according to claim 36, wherein the film layer of the electrical backplate is made of metal, plastic, cloth, or paper.

39. The method according to claim 36 further comprising forming an electrical film on the film layer of the electrical backplate, wherein the electrical film is made of a conductive material.

40. The method according to claim 39, wherein the electrical film of the electrical backplate is made of aluminum, gold, silver, copper, Ni/Au, ITO, IZO, or polymer conductive material PEDOT, or a combination of aluminum, gold, silver, copper, Ni/Au, ITO, IZO, and polymer conductive material PEDOT.

* * * * *